US008534910B2

(12) United States Patent
Baudet et al.

(10) Patent No.: US 8,534,910 B2
(45) Date of Patent: Sep. 17, 2013

(54) REGULATING MEMBER FOR A WRISTWATCH, AND TIMEPIECE COMPRISING SUCH A REGULATING MEMBER

(75) Inventors: Emmanuel Baudet, Savigny (CH); Bertrand Pichon, Neuchâtel (CH)

(73) Assignee: LVMH Swiss Manufactures SA, La Chaux-de-Fonds (CH)

( * ) Notice: Subject to any disclaimer, the term of this patent is extended or adjusted under 35 U.S.C. 154(b) by 0 days.

(21) Appl. No.: 13/461,153

(22) Filed: May 1, 2012

(65) Prior Publication Data

US 2012/0269043 A1 Oct. 25, 2012

Related U.S. Application Data

(63) Continuation of application No. PCT/EP2010/066634, filed on Nov. 2, 2010.

(30) Foreign Application Priority Data

Nov. 2, 2009 (CH) ..... 01691/09

(51) Int. Cl.
*G04B 15/00* (2006.01)

(52) U.S. Cl.
USPC ..... 368/126

(58) Field of Classification Search
USPC ..... 368/126, 127, 325, 168–169, 160, 368/157, 76, 163, 167, 175
See application file for complete search history.

(56) References Cited

U.S. PATENT DOCUMENTS

| | | | | |
|---|---|---|---|---|
| 1,380,329 | A | 5/1921 | Yolton | |
| 3,161,012 | A | 12/1964 | Hug et al. | |
| 3,577,874 | A * | 5/1971 | Mutter | 368/126 |
| 3,621,424 | A | 11/1971 | Query | |
| 3,670,492 | A | 6/1972 | Takamune et al. | |
| 3,877,215 | A | 4/1975 | Burckhardt et al. | |
| 4,266,291 | A * | 5/1981 | Obata et al. | 368/168 |
| 4,308,605 | A | 12/1981 | Ayer | |
| 5,638,640 | A | 6/1997 | Schiefele | |
| 7,396,154 | B2 * | 7/2008 | Houlon | 368/127 |
| 7,686,503 | B2 * | 3/2010 | Rochat et al. | 368/127 |
| 2003/0137901 | A1 | 7/2003 | Tokoro et al. | |

FOREIGN PATENT DOCUMENTS

| | | |
|---|---|---|
| CH | 235718 | 12/1944 |
| CH | 274901 | 4/1951 |
| CH | 615314 A3 | 3/1980 |

(Continued)

OTHER PUBLICATIONS

International Search Report for PCT/EP2010/066634 dated Feb. 25, 2011.

*Primary Examiner* — Edwin A. Leon
(74) *Attorney, Agent, or Firm* — Pearne & Gordon LLP

(57) ABSTRACT

A regulating member for a wristwatch movement includes a balance having at least one mobile magnet and a magnetic return member having at least one fixed permanent magnet. The permanent magnet engages with the mobile magnet of the balance, so as to generate a mechanical restoring torque for bringing the balance towards at least one resting position. The regulating member further includes an escapement for transmitting pulses to the balance so as to move the balance away from the resting position, and at least one yoke made of a ferromagnetic material for concentrating a magnetic flux of at least one of the permanent magnets.

22 Claims, 3 Drawing Sheets

(56) References Cited

FOREIGN PATENT DOCUMENTS

| | | | |
|---|---|---|---|
| EP | 1122619 | A1 | 8/2001 |
| GB | 615139 | | 1/1949 |
| GB | 644948 | | 10/1950 |
| GB | 1142676 | | 2/1969 |
| GB | 1175550 | | 12/1969 |
| WO | 2006/045824 | A2 | 5/2006 |

* cited by examiner

REGULATING MEMBER FOR A WRISTWATCH, AND TIMEPIECE COMPRISING SUCH A REGULATING MEMBER

CROSS-REFERENCE TO RELATED APPLICATIONS

The present application is a continuation of international application PCT/EP2010/66634 (WO2011051497) filed Nov. 2, 2010, the content of which is included by reference, and which claims priority of Swiss patent application 2009CH-01691 of Nov. 2, 2009, the content of which is included by reference.

BACKGROUND OF THE INVENTION

1. Field of the Invention

The present invention concerns a regulating member for a wristwatch, and a timepiece for a wristwatch comprising such a movement.

2. Description of the Prior Art

Usual mechanical watches comprise an energy accumulator constituted by a barrel, a kinematic chain, or gear-train, driving hands, a regulating member determining the working of the watch as well as an escapement for transmitting the oscillations of the regulating member to the gear-train. The present invention concerns in particular the regulating member.

The regulating members of conventional mechanical watches most often include a balance mounted on a rotation axis and a return member exerting a torque on the balance to bring it back towards a resting position. The escapement maintains the oscillations of the balance around the resting position. The return member generally includes a spring, the spiral or hairspring, which transmits a restoring torque to the balance through the collet.

The oscillator formed by the balance-hairspring pair offers remarkable properties for measuring time. It has however the disadvantage of being sensitive to gravity, which tends to deform the hairspring differently depending on the watch's tilt. Furthermore, the manufacture of the hairsprings is delicate and these elements are traditionally difficult to obtain.

Furthermore, electric watches are known whose working is regulated by an electromechanical oscillator comprising coils and magnets. For example, U.S. Pat. No. 4,266,291 describes an oscillating mechanism for a watchmaking application based on permanent magnets and requiring an electric power source to excite a stator with a pulsed current. GB1175550 describes a resonator having an H-shaped part provided with oscillating magnets in a magnetic field created by coils or electrostatic elements. The frequency of oscillation is determined by the geometry of the resonator.

By comparison to these documents, one aim of the present invention is notably to propose a regulating member that can also function in an entirely mechanical timepiece and without battery or other source of current.

On the other hand, CH615314 describes a regulating member with a balance and a hairspring conventional; the regularity of the oscillations is improved by means of a magnet mounted on a vibrating tab and vibrating in the magnetic field of a fixed magnet. In a similar manner, US2003/0137901 describes a mechanical watch comprising magnets for detecting or correcting the position of the balance; the frequency of the balance's oscillations is however determined by an ordinary hairspring. EP1122619 describes different embodiments of a mechanical watch whose balance is provided with magnets generating a magnetic field in fixed induction coils connected to the movement. The intensity of the current in the coils enables the amplitude of oscillation and thus the working of the watch to be controlled. It is also suggested to correct this function in the case of irregular oscillations. The movements of the balance are however stabilized by a hairspring and not by magnets.

Various documents further describe a magnetic escapement associated to a conventional regulating member. For example, U.S. Pat. No. 3,183,426 describes a magnetic escapement for watch movement. This device uses magnets placed on the balance. It is however not suggested to do away with or replace the hairspring.

Similarly, CH274901 describes various embodiments of mechanical escapements associated to a regulating member with conventional hairspring.

These different solutions thus require an additional magnetic system besides the spiral hairsprings. They thus have all the disadvantages connected to the spiral hairspring, whilst also adding further complexity. One aim of the present invention relative to these various solutions is thus to eliminate the spiral hairspring.

U.S. Pat. No. 3,877,215 describes a member comprising a tuning-fork whose vibrations are transmitted to the balance through magnetic coupling. GB1142676 describes another mechanical and magnetic oscillator with a tuning-fork. CH235718 describes a regulating member for a watch comprising a flexible oscillating rod whose extremity is provided with a magnet vibrating in the magnetic field of a fixed magnetic pole.

These solutions make it possible to eliminate the spiral hairspring but replace it by a tuning-fork whose elastic deformations determine the working of the watch. The manufacture of an accurate tuning-fork poses problems similar or even more complex than the manufacture of a high precision hairspring.

U.S. Pat. No. 3,621,424 describes a pendulum oscillating in a magnetic field caused by a single magnet connected to the escapement. The magnet thus serves both for the escapement and to bring the pendulum back to its position of equilibrium. The pendulum must however be subjected to the force of gravity and can only function in vertical position, i.e. in a clock.

U.S. Pat. No. 4,308,605 describes a regulating member for a timepiece provided with a vertical-axis balance. Magnets enable the gravitation force to be compensated in order to offset the pressure differences on the two bearings and limit the flexion of the staff of the balance wheel due to its own weight. A conventional hairspring controls the oscillations.

U.S. Pat. No. 5,638,340 concerns a table clock with an oscillating pendulum that is levitated in a magnetic field and which, in one embodiment, determines the working of the watch. The oscillating member is thus totally decoupled from the kinematic hands driving chain. This device however requires a source of electric energy to produce the levitation magnetic field and for the optoelectronic sensors servo-controlling the position of the pendulum. The mechanism is not adapted to a wristwatch.

GB615139 mentions a clock with vertical gravitational pendulum. The extremity of the pendulum oscillates along a circular trajectory controlled by magnets and thus drives the watch's movement.

By comparison with these four latter documents, one aim of the present invention is notably to propose a regulating member adapted to a wristwatch and whose function and working are practically independent of gravity and of the orientation of the regulating member relative to the vertical.

GB644948 describes a galvanometer with an inertial mass provided with two mobile magnets. A fixed permanent magnet generates a magnetic field enabling the balance to be brought back into its position of equilibrium. A conventional anchor escapement maintains the oscillations. This solution is only sketched in a schematic manner; magnets having a relatively large size are however necessary. These magnets generate a magnetic field all around the regulating member, which is likely to disturb the working of the device and to attract parts or members nearby.

Patent application WO2006/045824 in the name of the applicant, whose content is integrated herewith by way of reference, proposes to replace the spiral hairspring of the prior art by at least one permanent magnet that pushes the balance back towards its resting position against the escapement's pulses. The magnet's magnetic force is independent of its orientation in space and it is thus possible to avoid disturbances of the isochronicity that characterize spiral hairsprings when they deform under the action of gravity.

The solution described in patent application WO2006/045824 uses fixed magnets relatively distant from the mobile magnets on the balance, in order to push these mobile magnets towards the remote resting position. It is thus necessary to use powerful and thus bulky magnets in order to generate a sufficient repulsion force. It has however been observed during tests and simulations in the frame of the invention that a large part of the magnetic flux created by these magnets does not contribute to the function of the balance and escapes towards other components of the movement, whose running it disturbs.

BRIEF SUMMARY OF THE INVENTION

One aim of the present invention is thus to reduce the disturbances caused by the magnetic field of the magnets on the rest of the movement.

Another aim is to make a regulating member capable of functioning with permanent magnets that are less powerful and have small space requirements.

In particular, another aim of the present invention is to propose a magnetic regulating member that is dimensioned and can if necessary also be integrated into a mechanical wristwatch movement of small size or even in an additional module superimposed over an existing base movement.

Another aim is to propose a regulating member whose isochronicity is improved over the regulating members of the prior art.

Another aim is to propose a regulating member that is less sensitive to shocks and accelerations than the regulating members of the prior art, in particular a regulating member whose period is less disturbed by external shocks than the known regulating members.

Another aim of the present invention is also to propose a mechanical timepiece based on a magnetic regulating member and that does not have a spiral hairspring.

Another aim is notably to propose a magnetic regulating member capable of oscillating at a high frequency and that is thus adapted for measuring time with a very high accuracy and/or at a very high resolution, for example for mechanical chronograph applications to the tenths, hundredth or even thousandth of a second.

It is important for most watch brands to regularly propose technical innovations; it is a true challenge, given the number of published documents relating to mechanical watches. One aim of the present invention is thus also to propose a regulating member for a wristwatch that is new and different from the regulating members of the prior art.

According to the invention, these aims are achieved by means of a regulating member having the characteristics of the main claim, with preferred embodiments being indicated in the dependent claims.

These aims are achieved notably by means of a regulating member for a wristwatch, including:

- a balance comprising at least one mobile permanent magnet;
- a magnetic return member comprising at least one fixed permanent magnet engaging with said mobile permanent magnet of the balance, so as to generate a torque for bringing said balance towards at least one resting position;
- an escapement for transmitting pulses to the balance so as to move said balance away from said resting position;
- at least one yoke for concentrating the magnetic flux of at least one said permanent magnet.

Use of a yoke that is preferably (but not necessarily) ferromagnetic makes it possible to concentrate the magnetic field created by the fixed permanent magnets and/or that generated by the mobile permanent magnets, and to avoid notably that it disturbs the other elements of the watch. As compared to a simple shield, a yoke is advantageous since it further allows this magnetic field to be guided towards the place where it is used, so that the greater part of this field contributes to returning the balance and in order to control the value and direction of the magnetic field lines in space.

In one advantageous embodiment, the fixed magnets are connected to the plate or to a bridge, and polarized so as to attract the mobile magnets of the balance towards the position of equilibrium. The distance between the opposite poles of the fixed and mobile magnets is thus minimal at the resting position, so that the attraction torque towards this resting position is considerable.

This considerable torque enables the balance to be made to oscillate at a high frequency, and thus to achieve an improved resolution in the time measurement. If a very high frequency is not indispensable, it is also possible to reduce this torque by using permanent magnets of smaller size, which allows the movement to be made smaller.

In an advantageous embodiment, the restoring torque C of the balance varies in a manner proportional or roughly proportional to the angular position Θ of the balance:

$$C \cong k \cdot \Theta$$

wherein K is a constant and Θ indicates the deviation angle of the balance relative to the resting position. This relation is preferably true for at least part of the angular segment traveled by the balance during its normal oscillations, preferably for the greater part of this segment. Thanks to this linear relation, the regulating member functions in a nearly isochronous fashion, i.e. the period of oscillation is nearly independent from its amplitude.

This linear relation between the torque and the angular position is achieved by one or several of the following measures, which can be combined:

- Particular choice of the shape of the fixed permanent magnets. It will for example be possible to use fixed permanent magnets of unusual shape (i.e. non parallelepiped, non annular and non cylindrical) in order to control accurately the magnetic field generated in the space traveled by the balance during its oscillations. Fixed permanent magnets whose radial section (in a plane comprising the balance's axis) varies in a continuous fashion with the angle Θ, at least on a substantial portion of the fixed magnets can for instance be used. Furthermore, the intensity of the power supply can vary continuously inside the volume of the fixed magnets.

Similarly, the shape of the mobile magnets (permanent or punctual) can also be chosen so as to ensure this non-linear relation. It will for example be possible to use permanent or punctual magnets of non parallelepiped, non annular and non cylindrical shape, for example magnets in a half-moon shape, in order to control accurately the magnetic restoring torque depending on the distance between these mobile magnets and the fixed magnets. Here too, the intensity of permanent magnetization can vary continuously in the volume of the mobile magnets.

The yoke also participates in generating the magnetic restoring field of the balance. Its shape, as well as the shape of the air-gap between the yoke and the balance, are advantageously chosen so as to ensure the linear relation between the restoring torque and the angular deviation.

In one embodiment, the average magnitude of the balance's oscillations is lower than the usual amplitude of the balance's oscillations in a classic regulating member according to the prior art. For example, the amplitude of the oscillations is less than 180°, preferably less than 60°, preferably less than 30°, or even preferably less than 20°. This reduced balancing amplitude has several advantages. On the one hand, it allows the linearity of the relation between the mechanical restoring torque of the balance and its angular position Θ to be improved; it is easier to ensure a linear relation on a small angular segment than on a big one. The isochronicity is thus improved. On the other hand, this limited amplitude makes easier the manufacture of high-frequency oscillators and thus enables the resolution of the regulating member to be improved.

In one embodiment, the yoke can be deformed in a calculated and optimized manner in order to compensate the variations of the magnetic field generated by the magnets depending on the temperature. For example, the magnetic path through the yoke can include one or several air gaps whose width varies depending on the temperature, with this variation being calculated and optimized for example by means of finite elements analysis so as to make the magnetic field less sensitive to temperature variations.

DESCRIPTION OF THE DRAWINGS

The invention will be better understood by reading the description of different embodiments illustrated by the figures, which show.

DETAILED DESCRIPTION OF THE INVENTION

Figure 1:
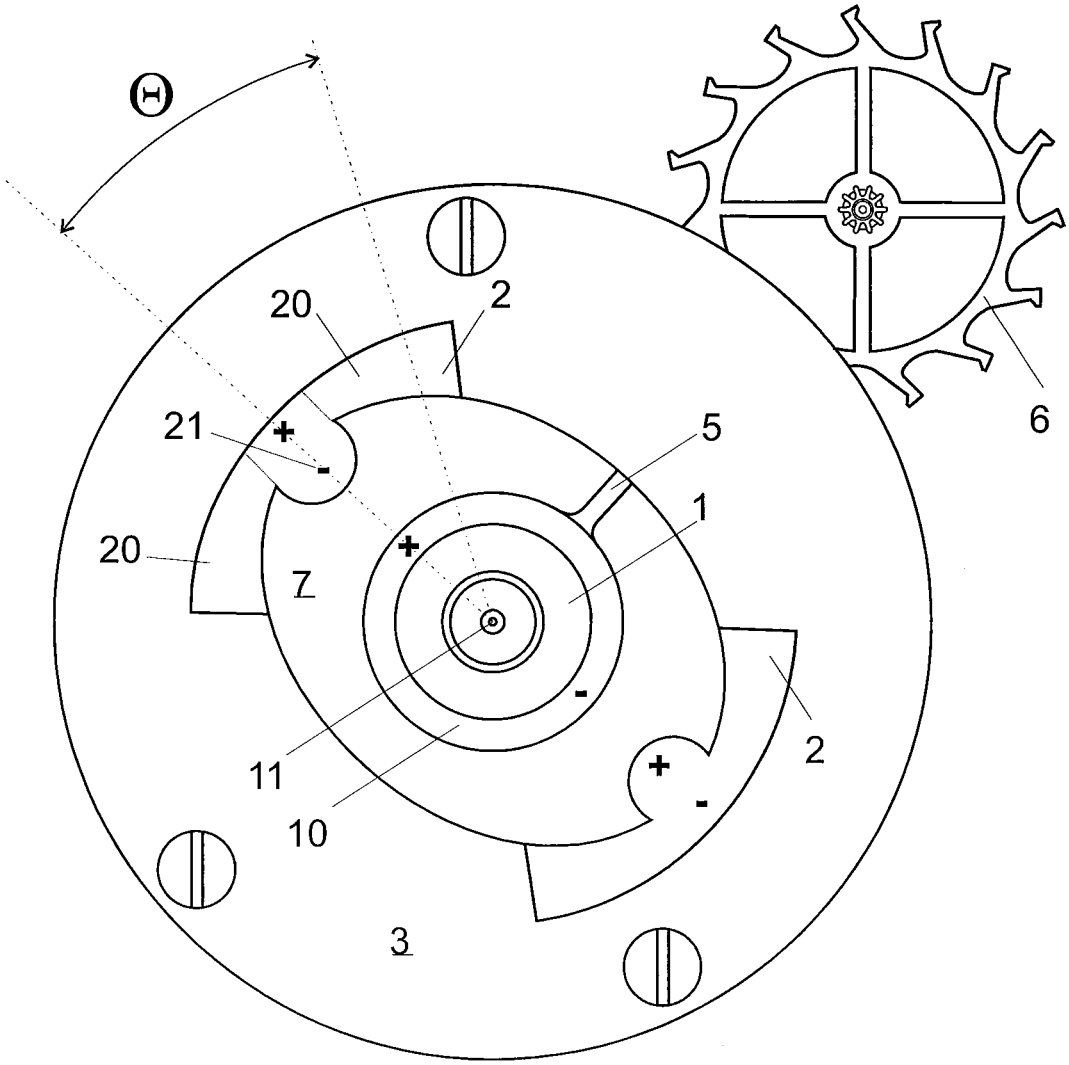
FIG. 1 a view from above of a regulating member according to a first embodiment.

FIG. 1 illustrates a view from above of a regulating member for a wristwatch movement according to a first embodiment of the invention. The regulating member includes mainly an oscillator with a balance 1 whose parts in the plane of the magnets only have been represented; the complete balance preferably includes a felloe, not represented, mounted on the same axis 11 but in another plane.

The oscillator also comprises fixed permanent magnets 2 as well as an escapement, of which only the escapement wheel 6 and a portion of the anchor 5 are represented. The escapement 5, 6 is in this example entirely conventional and can be constituted by a known anchor escapement. Other types of escapement, including for example magnetic escapements, can however also be used in this variant as well as in the other embodiments described in the application.

The balance 1 of the oscillator turns around an axis 11 connected to a bridge and to the main-plate by means of bearings, not represented, for example incabloc bearings or magnetic bearings. In the embodiment represented, a ring portion 10 at the periphery of the balance 1 is magnetized in a permanent fashion and without discontinuities all around the balance. This ring portion 10 constitutes a dipole with two opposite poles, spaced in this example by 180° and represented symbolically with the symbols + and −.

In the variant of FIG. 1, the permanent magnets 10 of the balance 1 are constituted by a ring that is magnetized in continuous fashion. This arrangement is advantageous since it is more thus easier to achieve a restoring torque that varies in a linear and continuous fashion with the angular deviation Θ of the balance relative to the resting position. It is however also possible to provide the balance 1 with several discrete glued or added on magnets or to use a magnetization zone or intensity that varies depending on the angular position around the balance. In another variant, the ring 10 is discontinuous, and provided for example with one or several air-gaps, or magnetized with magnetization gaps/discontinuities. The magnetization of the periphery 10 of the balance 1 can for example be achieved by magnetizing it by means of a recording head.

The regulating member of this example comprises two fixed permanent magnets 2 placed at 180° one to the other on each side of the balance. One of the poles of each magnet is directed towards the inside of the regulating member and the opposite pole outwards. Furthermore, the polarities of the two fixed permanent magnets 2 are opposite to one another, as illustrated with the symbols + and −. Reference number 7 corresponds to the air gap (interstice or clearance) between the fixed permanent magnets 2 of the stator and the mobile magnets 10 of the rotor.

In the figure, the balance 1 is represented in resting position, and the two poles of the balance 1 are each placed opposite the middle of the fixed magnet 2 of opposite polarity. When the balance 1 moves away from this resting position, for example under the effect of the escapement or of a shock, one of the two fixed permanent magnets 2 attracts it again, whilst the other opposite magnet pushes it back towards this resting position.

The fixed permanent magnets 10 in this example advantageously have a shape comprising a central portion 21 and peripheral portions 20 on each side of the central portion 21. The cross section of the two peripheral portions 20 in a plane that is radially perpendicular to the page increases gradually when moving further away from the central portion 21. There results a magnetic field and thus a mechanical restoring torque, which grow linearly along the entire section 20 when the balance 1 moves away from its resting position.

The central portion 21 of the fixed permanent magnets 2 however forms a protuberance and thus has a considerable radial cross section. These protuberances 21 have several important effects:

on the one hand, they enable the direction of the magnetic field lines to be controlled and to ensure that these lines are as rectilinear as possible along the stator's symmetry axis, whilst avoiding deformations that invariably arise at both extremities if the magnetic field were too weak in this portion 21.

on the other hand, these protuberances enable a localized magnetic attraction zone to be created very close to the desired resting zone, and thus to avoid that the balance stops at one or several other possible equilibrium zones (for example towards the discontinuities at the junction between the magnets 2 and the yoke 3).

These protuberances admittedly have the disadvantage of introducing a discontinuity in the relation between the angular deviation and the mechanical restoring torque; the torque increases instead of diminishing when the magnetic poles of the balance 1 are located in the immediate proximity to these protuberances 21 and when the balance moves closer to the resting position. This disturbance is however very localized and yet has little adverse effect on isochronicity, since it is produced only when the balance 1 receives the pulse from the escapement; this pulse introduces an appreciably greater disturbance than that produced by the protuberances 21, whose effect on isochronicity can be disregarded.

Other means than protuberances can be conceived to reinforce very locally the magnetic field close to the resting positions; for example, it would be possible to magnetize more the magnets 2 at this location, or to increase their thickness.

A yoke 3 of soft magnetic material holds and connects the two fixed magnets 2 to one another. This yoke also enables the magnetic flux to be guided between these magnets and to limit the portion of the magnetic flux that escapes to other components of the watch. On the other hand, the magnetic field re-issued by this yoke 3 also participates in generating the balance's restoring torque and is used to control the direction and amplitude of this field in space. The shape roughly in the form of a non-circular ellipse of the air gap 7 between the yoke 3 and the balance 1 will be observed. This shape, determined by calculation and numeric simulation, is optimized in order to ensure the linearity between deviation angle and torque and notably to ensure the restoring force is sufficiently large when the balance 1 moves away from the resting position and overshoots the angular segment of approximately 60° defined by the two permanent magnets 20. "Roughly in the form of an ellipse" means here that the ellipse is deformed at both longitudinal extremities by the protuberances 21; an ovaloid shape that is not strictly elliptical could also be contemplated.

Mechanical or magnetic stops can be provided in order to limit the maximum amplitude of the oscillations of the balance 1. A magnetic stop, for example a zone of high magnetization integrally united with the yoke 3, makes it possible to push the balance back to its resting position without having the disadvantages of mechanical stops causing shocks likely to disrupt the isochronous working of the balance.

Figure 2:
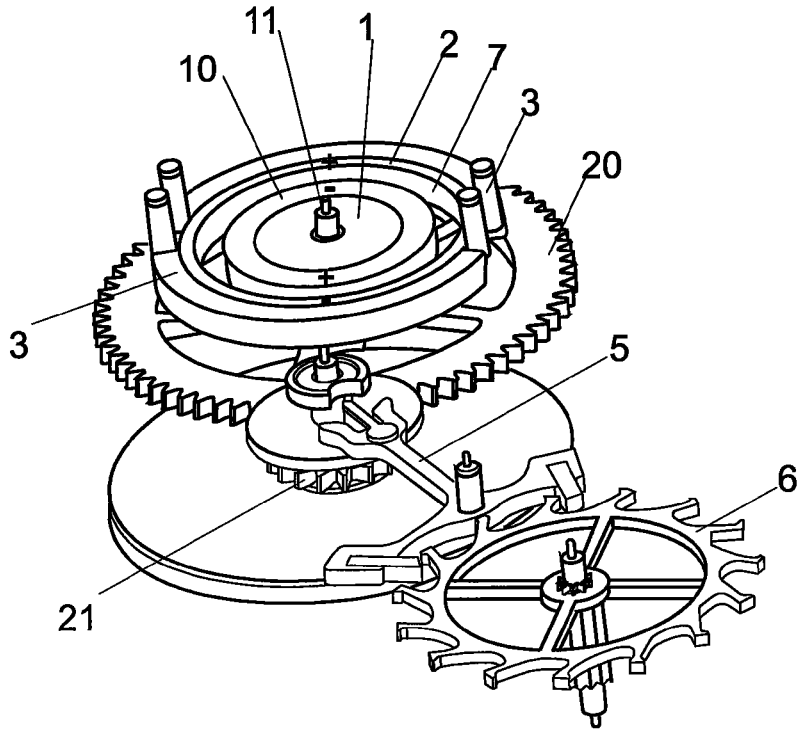
FIG. 2 a perspective view of a regulating member according to a second embodiment.

FIG. 2 illustrates another variant of magnetic regulating member according to the invention. The balance 1 is made in the same manner as in the example of FIG. 1 and comprises a magnetized peripheral ring section 10. The fixed permanent magnets 2 however have a simpler shape and comprise a single magnetized circular ring around the balance. A yoke 3, here in two parts, surrounds this ring 2 and thus constitutes a magnetic shield preventing the magnetic field from exiting.

In this arrangement, the restoring torque is only very approximately proportional to the angular deviation $\Theta$ of the balance. In order to nevertheless ensure isochronicity, the balance 1 is forced here to perform small-amplitude oscillations on an angular segment sufficiently reduced so that the non-linearity can be practically disregarded.

To this effect, the regulating member comprises a demultiplier with a wheel 20 on the axis 11 of the balance and a pinion 21 actuated by the fork of the anchor 5. Thanks to this demultiplication, the pulses given by the escapement 5, 6 cause the balance to rotate with limited amplitude, so that the restoring torque is nearly linear in this limited zone.

Figure 3:
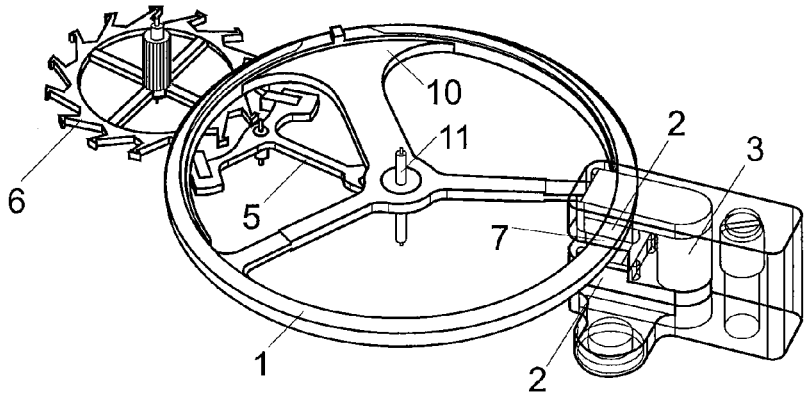
FIG. 3 a perspective view of a regulating member according to a third embodiment.

A similar demultiplication can also be used with a regulating member similar to that of FIG. 1, or of FIG. 3 for example. Furthermore, it is also possible to introduce a demultiplication upstream of the escapement wheel 6 rather than downstream as in the example; this variant enables the frictions in the regulating member to be reduced but has the disadvantage of not being capable of being integrated in an existing movement without complete re-design.

The demultiplication 20, 21 however has the disadvantage of introducing additional losses through friction.

Figure 4:
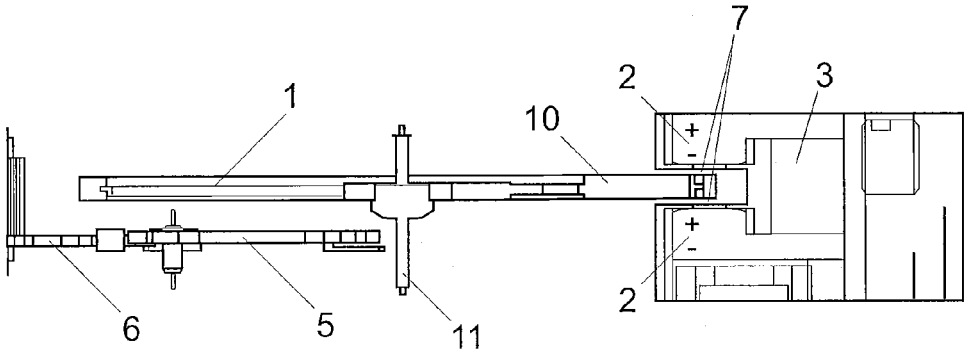
FIG. 4 a cross-sectional view of a regulating member according to the third embodiment.

FIGS. 3 and 4 illustrate another embodiment in which two permanent magnets 2 are placed in two planes above respectively below the plane of the balance 1. In the example, the positive pole of the upper permanent magnet 2 is directed towards the balance whilst the negative pole of the lower permanent magnet is directed towards the balance. A yoke 3 connects and holds the two permanent magnets 2 and thus reinforces the magnetic field in the air gap 7 between the two magnets and the balance.

The balance 1 is provided with a single magnet 10, here a non-permanent magnet (punctual magnet) constituted of a ferromagnetic material. This magnet forms one of the spokes connecting the periphery of the balance to its axis 11. The outer extremity of this spoke widens into the shape of a half-moon. The magnetization of this magnet is thus determined by the magnetic field generated by the two fixed permanent magnets 2. The half-moon shape of the magnetized zone 10 ensures a restoring torque that varies linearly with the deviation angle relative to the resting position (not represented).

Other variant embodiments can be conceived in the frame of the invention. For example, it is possible to provide the balance 1 with one or several permanent magnets and with a mobile yoke of ferromagnetic material (or not) to direct the magnetic field between these magnets. The fixed yoke—or the mobile yoke—can be provided with an air gap to avoid the risk of saturation of the ferromagnetic material. It is also possible to use yokes formed of ferromagnetic sheets or grains of ferromagnetic materials, in order to control the induced currents that could circulate therein. In a preferred embodiment, a yoke made from a 50-50 alloy of iron and nickel and with low magnetic hysteresis will however be used.

The variation of the magnetic field and of the magnetic torque depending on the angular deviation can also be controlled by modifying the thickness, the cross section in a radial plane and/or the magnetization of the fixed or mobile magnets depending on the angular position.

In all the above variants, the isochronicity accuracy depends for a large part on the shape of the permanent magnets. Initial manufacturing tests with current magnets of the neodymium type or with other current permanent magnets have however proved rather inconclusive since it is difficult or costly to machine, with the required dimensional precision, the sintered materials that constitute these usual materials.

According to an independent characteristic of the invention, the regulating member implements permanent magnets in materials that are admittedly less powerful than neodymium and other modern materials commonly used, but which have the advantage of being un-sintered and available in crystalline form; they can thus be machined more easily with the high precision required. In one advantageous embodiment, the magnets are on the based of un-sintered cobalt platinum, which belongs to the materials whose magnetic remanence is little affected by temperature variations. This material also has the advantage of being poorly oxidizable and it therefore does not need to be nickel-plated to be protected. Convincing tests have been achieved with magnets constituted of 75 to 78% of platinum (for example 76.85%) and less than 24% of cobalt.

A heat treatment is preferably applied to the magnets after their machining, in order to render them magnetizable.

The permanent magnets made in these materials can be machined with such precision that they are preferably simply chased or held mechanically in the movement; thus, it is possible to avoid using glues, which disturb the direction of the magnetic field lines.

Other un-sintered magnetic materials can be used for the permanent magnets, including magnets on the basis of micropowders, plastic magnets or other ductile magnetic alloys (Fe—Cr—Co, Remalloy, Cunife, Cunico, Vicalloy etc). The weak coercive field of these other materials will however make their use less appropriate to watchmaking applications; it is necessary to use considerable volumes to generate the necessary magnetic fields. Moreover, the generated magnetic field also depends considerably on temperature variations.

The working of the watch is determined at least partially by the magnetic field developed by the different permanent magnets and by the magnetic attraction force exerted on the balance. This field and this force will however vary with each individual magnet and it is difficult to ensure perfect reproducibility during mass production. In order to compensate for this variability, the regulating member advantageously includes means for adjusting the position of at least one individual magnet, enabling it to be adjusted during assembly in order to regulate the working of the watch. In an advantageous embodiment, these means are for example constituted by at least one micrometric screw or another threaded element enabling at least one corresponding fixed permanent magnet of the balance to be moved closer or further away, in order to influence the magnetic field exerted by this magnet on the magnetized portions of the balance. It is also possible to adjust the angular distance between two permanent magnets.

Other adjusting means can be provided, for example by playing on the size of an air gap in the yoke or by adding or moving compensatory masses on the balance.

Furthermore, temperature-compensating means can also be implemented, for example by using a classic bimetallic balance that deforms under the effect of temperature. In one variant, components with a high dilatation coefficient, or bimetallic components, are used to displace the fixed or mobile permanent magnets depending on the temperature, in order notably to compensate the variations of the magnets' efficiency when the temperature varies.

In one embodiment, the yoke can be deformed in a calculated and optimized manner in order to offset the variations of magnetic field generated by the magnets depending on the temperature. For example, the magnetic path through the yoke can include one or several air gaps whose width varies depending on the temperature, with the variation being calculated and optimized for example by means of finite element analysis so as to make the magnetic field less sensitive to temperature variations.

Figure 5:
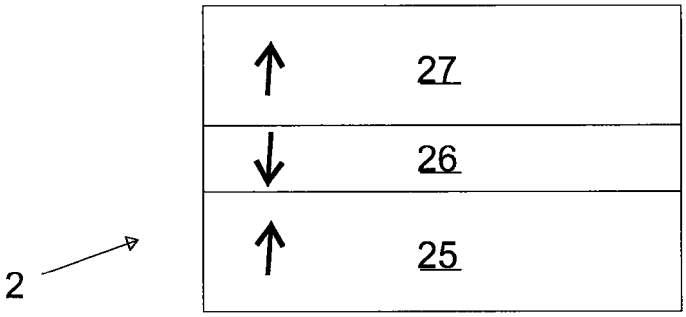
FIG. 5 a cross-sectional view of a multi-layer and multi-material magnet.

FIG. 5 illustrates a cross-sectional view of a multilayer magnet generating a magnetic field nearly independent of the temperature in the useful temperature ranges. In this example, the magnet comprises a layer 25 and another 27 polarized in the same direction and both made from a material whose magnetic remanence varies little with temperature. The intermediary layer 26 is made of another material that is polarized in opposite direction and that generates a lower magnetic field than the sum of the fields generated by the two layers 25 and 27. The magnetic remanence of the layer 26 however varies considerably depending on the temperature. The stacking resulting from the layers 25 to 27 is equivalent to a magnet polarized in the same direction as the layers 25 and 27, with the amplitude of the resulting field being diminished by the layer 26. By carefully selecting the materials and thicknesses of the layers 25 to 27, it is thus possible to produce a magnet whose remanence variations in the layers 25 and 27 are almost totally cancelled by the variations in the layer or layers 26 polarized in opposite direction.

The number of layers and/or of materials used for making magnets that are not sensitive to temperature can be different from the example given by way of illustration in FIG. 4. In one embodiment, the magnets are formed of several materials whose remanence variations compensate each other but without arranging the materials in layers. Multilayer or multimaterial magnets can be used both for the fixed permanent magnets as well as for the mobile permanent magnets.

In one embodiment, the currents induced by the turning magnetic field created by the rotation of the magnetic balance are used to regulate the working of the watch. These currents can for example be measured by means of a coil connected to the movement, and their frequency or their phase can be used by an electronic circuit (which can itself be powered by these currents) to determine the working of the watch and possibly correct it.

The bridges, plates, gear-trains and other mobile elements close to the regulating member are preferably made from an a-magnetic material in order to limit the disturbances caused by the parasite magnetic fluxes that escape from the member despite the yoke. Magnetic shielding can be provided to separate magnetically the regulating member from the sensitive elements, at least in some directions. A grounding (i.e. at the plate) of the nearby elements in which currents can be induced can furthermore advantageously be provided in order to protect these elements.

The regulating member described proves particularly efficient for generating considerable restoring torques and thus high oscillation frequencies. A possible application concerns for example a regulating member for chronograph element; the high oscillation frequency enables the resolution to be considerably improved and to mechanically time durations with a resolution to the tenth, hundredth or even thousandth of a second. For example, it is possible in the frame of the invention to make regulating members with more than 72,000 vibrations per hour, for example 360,000 vibrations, 720,000 vibrations or even more. Even if the energy dissipated by the escapement and the gear-train at such frequencies is considerable, it is not detrimental for use in a chronometer designed to be used during limited periods. Furthermore, it is possible to drive this high-frequency regulating member with an additional barrel, for example one that is independent of the main barrel used for displaying the time.

High frequencies will however require powerful or very thick magnets, which goes against the wish for miniaturization.

Such a regulating member can for example be added to the main regulating member used in a wristwatch movement to indicate the time. The watch in this case includes a very high resolution and very high precision regulating member dedicated to measuring chronometered durations.

This magnetic regulating member can furthermore be mounted in the same movement than the main regulating member or in an auxiliary module superimposed above the base module, for example in an additional chronograph module.

The claimed solution further has the advantage of doing without a spiral hairspring. In addition to the advantages mentioned further above (supply, disturbances due to gravity etc.), doing without this element makes it possible to see through the regulating member, between the spokes of the balance, without the hairspring constituting a barrier to the background components. The regulating member of the invention will thus advantageously be placed behind an opening of the dial or in the bottom of the watch, so as to clearly show the quickly oscillating balance and the components behind this balance.

The regulating member of the invention is preferably mounted in a movement and in a watchcase showing at least part of the balance, which makes it possible for the user to control its displacements at any time.

What is claimed is:

1. A regulating member for a wristwatch movement, including:

a balance (1) comprising at least one mobile magnet (10);

a magnetic return member comprising at least one fixed permanent magnet (2) engaging with said mobile magnet (10) of the balance, so as to generate a mechanical restoring torque for bringing said balance towards at least one resting position;

an escapement (5, 6) for transmitting pulses to the balance so as to move said balance (1) away from said resting position;

the regulating member further comprising at least one yoke (3) of ferromagnetic material for concentrating a magnetic flux of at least one said permanent magnet.

2. The regulating member of claim 1, wherein said mechanical restoring couple varies in a substantially continuous and linear manner depending on the angular deviation of the balance (1) relative to the resting position.

3. The regulating member of claim 2, wherein at least one of the magnets (2, 10) has a non parallelepiped, non annular and non cylindrical shape, adapted so as to ensure proportionality between the mechanical restoring torque and the angular deviation of the balance (1) relative to the resting position.

4. The regulating member of claim 3, wherein the shape of at least one fixed permanent magnet (2) is adapted so as to improve proportionality between the mechanical restoring torque and the angular deviation of the balance (1) relative to the resting position.

5. The regulating member of claim 3, wherein the shape of at least one mobile magnet (10) is adapted so as to ensure proportionality between the mechanical restoring torque and the angular deviation of the balance (1) relative to the resting position.

6. The regulating member of claim 2, wherein the magnetic field generated by at least one said fixed permanent magnet (2) and by the yoke (3) varies in a continuous fashion along the periphery of the regulating member.

7. The regulating member of claim 1, wherein the magnetic field contributes to returning the balance to the resting position, wherein the regulating member comprising an air gap (7) separates the yoke (3) from the balance (1), wherein the shape of the air gap is determined so as to ensure proportionality between the mechanical restoring torque and the angular deviation of the balance (1) relative to the resting position.

8. The regulating member of claim 7, including an air gap (7) of roughly elliptical shape.

9. The regulating member of claim 7, wherein the width of said air gap is reduced locally by protuberances (21) to reinforce locally the magnetic field close to the resting positions.

10. The regulating member of claim 1, wherein said yoke includes an air gap whose size varies according to the temperature so as to compensate at least partially the variations in magnetic field generated by the magnets.

11. The regulating member of claim 1, wherein the balancing angle of the balance is less than 60°.

12. The regulating member of claim 1, wherein said escapement is an anchor escapement (5, 6), with the member including a demultiplication between said anchor (5) and the balance (1).

13. The regulating member of claim 1, including:

two fixed permanent magnets (2) whose cross section increases with the angular distance relative to the resting position, on at least one section (20) of each of the two magnets on each side of the resting position (21), the yoke (3) connected to two permanent magnets, the balance (1) with a peripheral ring zone (10) magnetized in a permanent fashion.

14. The regulating member of claim 1, including:

one or several permanent magnets (2) of ring shape around the balance;

the yoke (3) surrounding said permanent magnets (2);

the balance (1) with a peripheral ring zone (10) magnetized in a permanent fashion.

15. The regulating member of claim 1, including:

the balance (1) with a portion magnetized in a permanent fashion;

a first permanent magnet (2) in a plane above the balance;

a second permanent magnet (2) in a plane below the balance;

the yoke (3) creating a magnetic path between said permanent magnets (2).

16. The regulating member of claims 15, wherein the cross section of said magnetized portion of the balance (10) varies in a continuous manner with the angular distance relative to the resting position.

17. The regulating member of claim 1, wherein said permanent magnets are made in from an un-sintered crystalline material.

18. The regulating member of claim 1, wherein said permanent magnets are made from an alloy on the basis of platinum and cobalt.

19. The regulating member of claim 1, wherein said magnets include several materials (25, 26, 27) arranged so that the variations of magnetic remanence depending on the temperate will compensate each other.

20. The regulating member of claim 1, including means for adjusting the position of at least one fixed permanent magnet (2) in order to move it closer to or further away from the balance (1) and thus regulate the working of the watch.

21. Mechanical watch movement including a chronograph whose working is determined by a regulating member according to claim 1.

22. The movement of claim 21, including:

a first regulating member for determining the working of the watch; and:

said magnetic regulating member for determining the running of the chronograph, wherein the frequency of the magnetic regulating member used for determining the working of the watch is greater than the frequency of the first regulating member.

* * * * *